US005474275A

United States Patent [19]

Robertson et al.

[11] Patent Number: 5,474,275

[45] Date of Patent: Dec. 12, 1995

[54] BEACH TOWEL TACK

[76] Inventors: Kramer D. Robertson, 3835 Beverly Dr., Lake Worth, Fla. 33461-3919; George Spector, 233 Broadway Rm 702, New York, N.Y. 10279

[21] Appl. No.: 311,280

[22] Filed: Sep. 23, 1994

[51] Int. Cl.[6] ..... A47B 97/00

[52] U.S. Cl. ..... 248/508; 135/118

[58] Field of Search ..... 248/500, 508, 248/910; 135/118; 5/417, 419

[56] References Cited

U.S. PATENT DOCUMENTS

| | | | |
|---|---|---|---|
| 1,801,014 | 4/1931 | Lange | 135/118 X |
| 2,840,092 | 6/1958 | Hill | 248/508 X |
| 4,065,171 | 12/1977 | Nagy | 248/910 X |
| 4,914,767 | 4/1990 | Balicki | 5/419 |
| 5,158,258 | 10/1992 | McFadzean | 248/508 X |
| 5,176,354 | 1/1993 | Feigenbaum | 248/508 |
| 5,245,715 | 9/1993 | Dinkins | 5/417 |
| 5,327,922 | 7/1994 | Deroche | 135/118 |

*Primary Examiner*—J. Franklin Foss

[57] ABSTRACT

A beach towel holding device comprising a clip member to engage with a corner of a beach towel. A component is for weighing down the clip member onto the ground, so as to maintain the clip member in a stationary position to secure the beach towel in place upon the ground.

5 Claims, 1 Drawing Sheet

BEACH TOWEL TACK

BACKGROUND OF THE INVENTION

The instant invention relates generally to anchoring structures and more specifically it relates to a beach towel holding device, which provides a structure that can be clamped onto a corner of the beach towel to secure it in place upon the sand.

There are available various conventional anchoring structures which do not provide the novel improvements of the invention herein disclosed.

SUMMARY OF THE INVENTION

A primary object of the present invention is to provide a beach towel holding device that will overcome the shortcomings of the prior art devices.

Another object is to provide a beach towel holding device that can be clamped onto a corner of the beach towel, so as to secure the beach towel in place upon the sand at the beach, at a pool or on a patio.

An additional object is to provide a beach towel holding device that can be weighted down by a sand bag and maintain in place with a built-in spike to better maintain the beach towel in place.

A further object is to provide a beach towel holding device that is simple and easy to use.

A still further object is to provide a beach towel holding device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
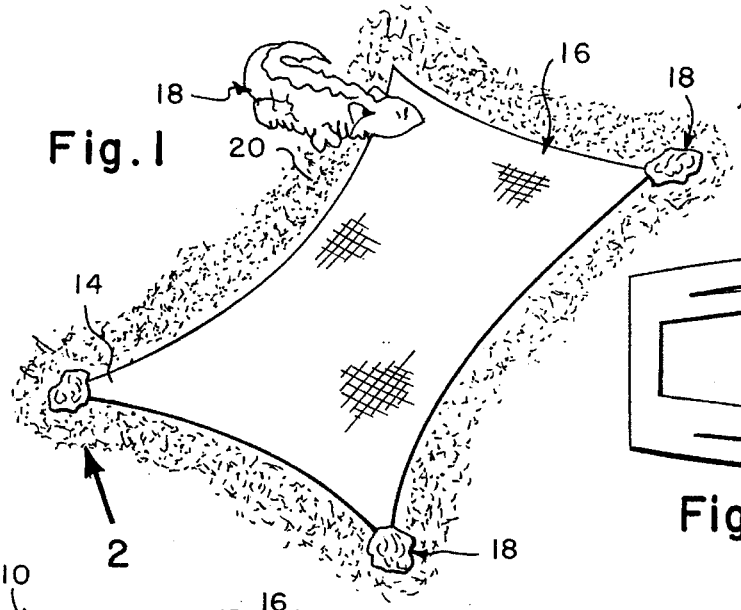
FIG. 1 is a perspective view showing the instant invention located on each corner of a beach towel.
Figure 3:
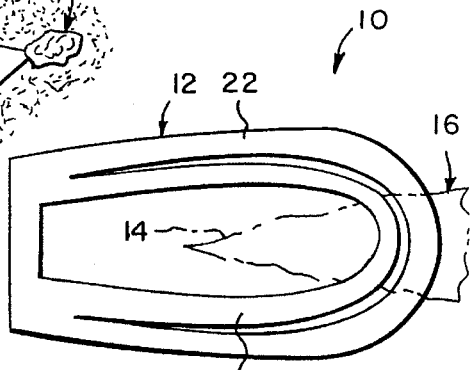
FIG. 3 is a top view taken in the direction of arrow 3 in FIG. 2, showing just the clip and the beach towel corner in phantom.

Turning now descriptively to the drawings, in which similar reference characters denote similar elements throughout the several views, FIGS. 1 through 5 illustrate a beach towel holding device 10 comprising a clip member 12 to engage with a corner 14 of a beach towel 16. A component 18 is for weighing down the clip member 12 onto the ground 20, so as to maintain the clip member 12 in a stationary position to secure the beach towel 16 in place upon the ground 20, which can be of sand. For best results four clip members 12 and four weighing down components 18 should be used for each corner 14 of the beach towel 16.

The clip member 12 includes a generally U-shaped flexible outer element 22 and a generally U-shaped flexible inner element 24. The corner 14 of the beach towel 16 can be inserted and retained between the forward curved portions of the outer element 22 and the inner element 24.

The weighing down component 18 is a sand bag 26 having a bottom pocket 28 to receive the inner element 24 therein. The sand bag 26 can be in the shape of an animal and made with a water resistant material.

Figure 5:
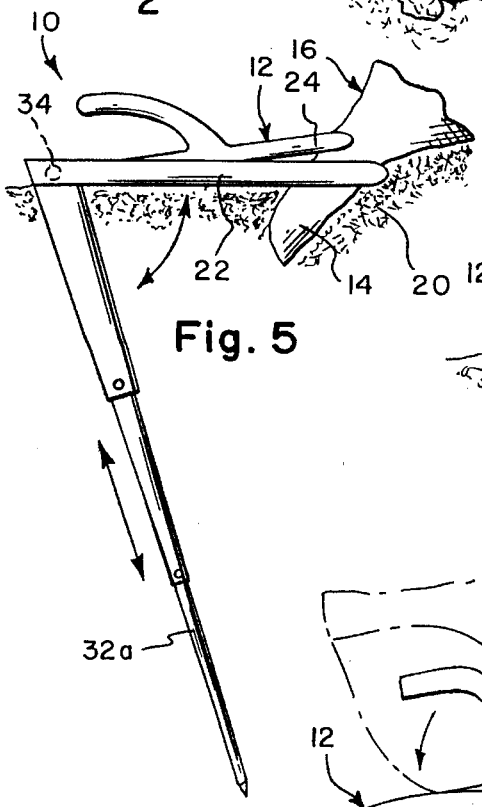
FIG. 5 is an enlarged side view similar to FIG. 4, showing a second modification to the clip having a rearward telescopic spike thereon, which will swivel closed in a collapsed stored position.
Figure 2:
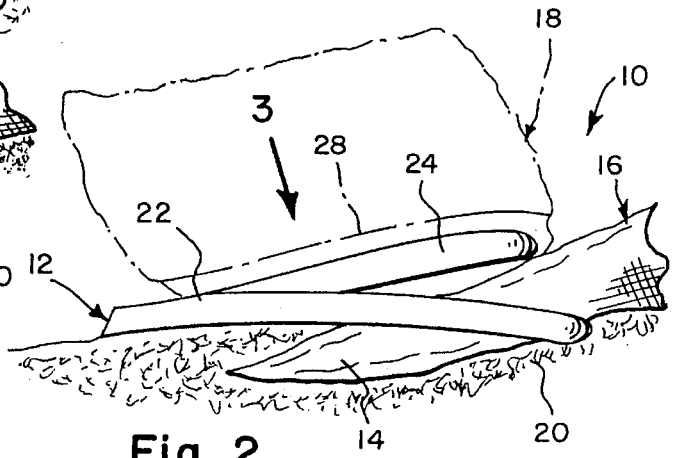
FIG. 2 is an enlarged side view taken in the direction of arrow 2 in FIG. 1, of one corner of the beach towel and the bag weight shown in phantom.
Figure 4:
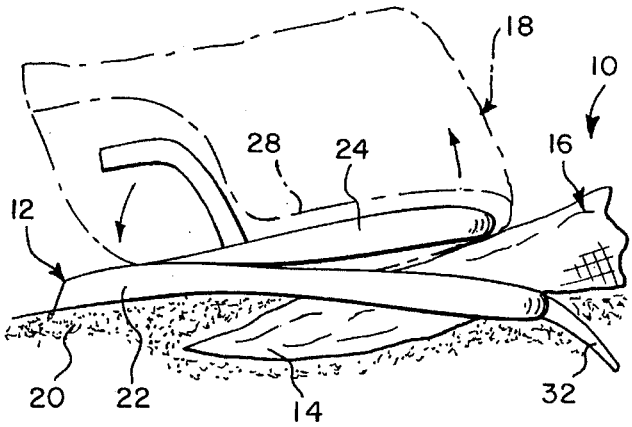
FIG. 4 is an enlarged side view similar to FIG. 2 showing a first modification to the clip having a lever handle which when squeezed will open the clip for insertion of the beach towel corner and a forward spike thereon to insert into the sand to better hold the clip stationary.

As shown in FIGS. 4 and 5, an upwardly extending curved lever handle 30 is on the inner element 24. When pressed downward, the lever handle 30 will cause the inner element 24 to lift upward for the insertion of the corner 14 of the beach towel 16.

In FIG. 4, a downwardly extending spike 32 is formed on the forward curved portion of the outer element 22 to be inserted into the ground 20 for better retainment.

FIG. 5 shows a telescopic spike **32*a* that is attached by a swivel pin 34 to a rearward end of the clip member 12. The telescopic spike 32*a* can swivel down to a work extended position to be inserted into the ground 20 for better retainment, and then can swivel up to a stored retracted position between the inner element 24**.

OPERATION OF THE INVENTION

To use the beach towel holding device 10, four clip members 12 will engage with four corners 14 of the beach towel 16. The four weighing down components 18 are placed upon the clip members 12. If the clip members 12 are provided with either the spikes 32 or **32*a*, they are then driven into the ground 20**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A beach towel holding device comprising:

a) a clip member to engage with a corner of a beach towel;

b) means for weighing down said clip member onto the ground, so as to maintain said clip member in a stationary position to secure the beach towel in place upon the ground; wherein said clip member includes:

c) a generally U-shaped flexible outer element;

d) a generally U-shaped flexible inner element, whereby the corner of the beach towel can be inserted and retained between the forward curved portions of said outer element and said inner element.

2. A beach towel holding device as recited in claim 1, wherein said weighing down means is a sand bag having a bottom pocket to receive said inner element therein.

3. A beach towel holding device as recited in claim 2, further including an upwardly extending curved lever handle on said inner element, which when pressed downward will cause said inner element to lift upward for the insertion of the corner of the beach towel.

4. A beach towel holding device as recited in claim 3, further including a downwardly extending spike formed on the forward curved portion of said outer element to be inserted into the ground for better retainment.

5. A beach towel holding device as recited in claim 3, further including a telescopic spike attached by a swivel pin to a rearward end of said clip member, whereby said telescopic spike can swivel down to a work extended position to be inserted into the ground for better retainment and then can swivel up to a stored retracted position between said inner element.

* * * * *